US009730521B2

(12) United States Patent
Paterson et al.

(10) Patent No.: US 9,730,521 B2
(45) Date of Patent: Aug. 15, 2017

(54) BENCH TOP FOR BENCH SEATS

(71) Applicant: Cascadia Sport Systems Inc., Port Moody (CA)

(72) Inventors: Murdo Paterson, Anmore (CA); Mal Paterson, Maple Ridge (CA); Shawn Kennedy, Port Moody (CA)

(73) Assignee: CASCADIA SPORT SYSTEMS INC., Port Moody (CA)

( * ) Notice: Subject to any disclaimer, the term of this patent is extended or adjusted under 35 U.S.C. 154(b) by 0 days.

(21) Appl. No.: 14/994,003

(22) Filed: Jan. 12, 2016

(65) Prior Publication Data

US 2017/0196359 A1 Jul. 13, 2017

(51) Int. Cl.
*A47C 11/00* (2006.01)
*A47C 7/16* (2006.01)

(52) U.S. Cl.
CPC ..... *A47C 7/16* (2013.01); *A47C 11/00* (2013.01)

(58) Field of Classification Search
CPC ..... A47C 7/16; A47C 11/00; A47C 11/005
See application file for complete search history.

(56) References Cited

U.S. PATENT DOCUMENTS 3,531,157 A * 9/1970 Duckett ..... A47C 1/12 297/248
4,054,316 A * 10/1977 DeLong ..... A47C 11/00 108/64
4,729,599 A * 3/1988 Nissen ..... E04H 3/12 297/219.1
4,790,594 A * 12/1988 Temos ..... A47C 1/12 29/464
5,070,664 A * 12/1991 Groh ..... A47C 1/16 428/334
5,368,360 A * 11/1994 Groh ..... A47C 7/021 108/90
5,505,517 A 4/1996 Groh et al.
5,921,626 A * 7/1999 Baker ..... A47C 1/16 297/219.1
6,182,344 B1 * 2/2001 Holland ..... A47C 1/16 29/243.5
6,352,306 B1 * 3/2002 Dreiling ..... A47C 1/16 297/252
2006/0108844 A1 * 5/2006 Suprina ..... A47C 1/12 297/217.7

* cited by examiner

*Primary Examiner* — Philip Gabler
(74) *Attorney, Agent, or Firm* — Borden Ladner Gervais LLP; Geoffrey Dekleine

(57) ABSTRACT

A bench top for a bench seat includes mounting elements for coupling to sides of bench seat members and a seat unit. The seat unit includes: a seating top; front and back members extending generally away from the seating top; ribs extending inwardly from the front and back members that, together with a front lip and a back lip, provide front and back pockets for receiving respective mounting elements therein; and joining elements at opposing sides of the seat unit for cooperating with joining elements of adjacent units. The seat unit is resilient to move the front and back lips away from each other for installation over the mounting elements and to return to a less flexed state as the front and back lips move toward each other when the mounting elements are received in the front and back pockets.

20 Claims, 4 Drawing Sheets

BENCH TOP FOR BENCH SEATS

FIELD OF TECHNOLOGY

The present invention relates to a bench top for bench seats, such as bleacher seats.

BACKGROUND

Bleacher seats may be utilized for seating at, for example, sporting events, and are commonly utilized because they are typically inexpensive while providing seating for many people in a relatively small area. Such bleacher seats are often unprotected from the elements such as the sun, rain, or snow. Thus, these seats are exposed to varying temperatures and weather conditions.

Bleacher seats that include wood seats may be susceptible to bleaching and cracking, particularly with prolonged exposure. In addition, such seats may also be susceptible to scratching, splintering, and staining during use.

As a result, bleacher seats that include metal seating, such as aluminum seats are utilized. Such seats are generally manufactured with ridges to reduce the chance of slipping on the seat surfaces. These aluminum seats, however, are generally uncomfortable and cold, particularly in cold climates.

Plastic seat covers may be utilized to provide a more comfortable seat surface but such plastic seat covers are susceptible to bowing and buckling during manufacture and as a result of expansion or contraction of the bleacher seat frames as the bleacher seats are exposed to the elements.

Improvements in durability of bench seats are therefore desirable.

SUMMARY

According to one aspect of an embodiment, a seat unit for a bench seat is provided. The seat unit includes a seating top, a front member coupled the seating top and extending generally away from the seating top, and a front lip extending inwardly from the front member, a back member coupled to a back of the seating top and extending generally away from the seating top, and a back lip extending inwardly from the back member. The front lip and the back lip provide front and back pockets in the seat unit, the front and back pockets sized to receive a respective mounting element therein. Joining elements are disposed at opposing sides of the seat unit for cooperating with joining elements of an adjacent seat unit for coupling the seat unit to an adjacent seat unit. The seat unit is resilient such that seat unit flexes for moving the front lip and the back lip away from each other for installation over the mounting elements when the mounting elements are coupled to sides of the bench seat, and the returning to a less flexed state as the front and the back lip move toward each other when the mounting elements are received in their respective front and back pockets.

According to another aspect of an embodiment, a bench top for a bench seat us provided. The bench top includes mounting elements for coupling to sides of bench seat members, the mounting elements have a main body including opposing side edges, a bottom edge, and a top, and a plurality of seat units. The plurality of seat unite each include a seating top, a front member coupled the seating top and extending generally away from the seating top, and a front lip extending inwardly from the front member, a back member coupled to a back of the seating top and extending generally away from the seating top, and a back lip extending inwardly from the back member, the front lip and the back lip, providing front and back pockets sized to receive respective mounting elements therein. The seating units also each include joining elements at opposing sides thereof for coupling the adjacent seat units. The seat units are resilient such that the seat units flex to move the front and the back lips away from each other for installation over the mounting elements and the seat units return to a less flexed state as the front and the back lips move toward each other when the mounting elements are received in their respective front and back pockets. The seat units abut adjacent ones of the plurality of seat units at sides thereof to provide the bench top.

BRIEF DESCRIPTION OF THE DRAWINGS

Embodiments of the present disclosure will now be described, by way of example only, with reference to the attached figures, in which.

DETAILED DESCRIPTION

Figure 1:
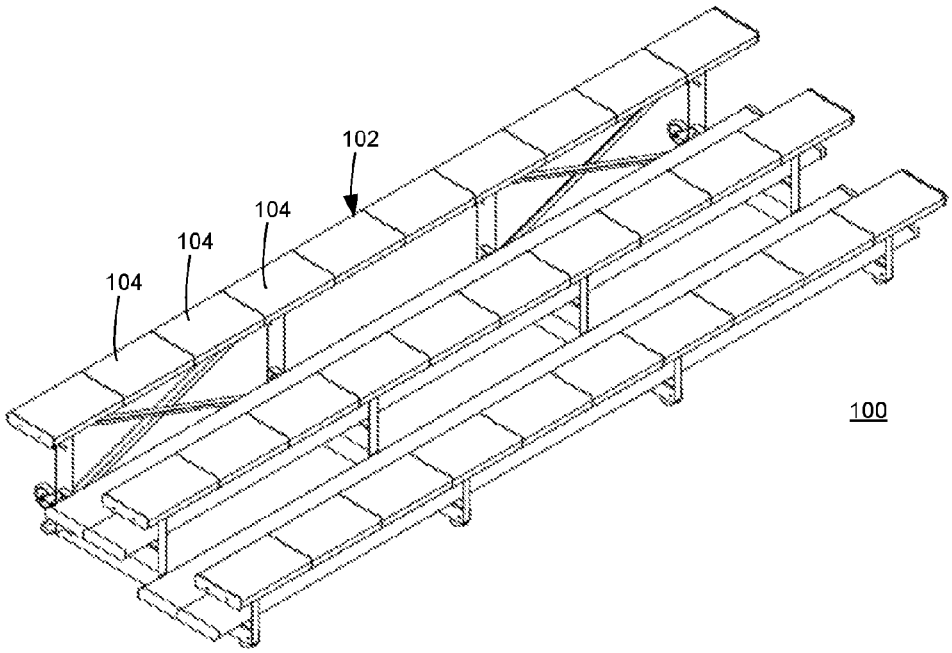
FIG. 1 is a perspective view of bleacher seats including a bench top for the bench seats in accordance with an aspect of an embodiment of the present invention.

The following describes a bench top for a bench seat. The bench top includes mounting elements for coupling to sides of bench seat members, the mounting elements have a main body including opposing side edges, a bottom edge, and a top, and a seat unit. The seat unit includes a seating top, a front member coupled the seating top and extending generally away from the seating top, and a front lip extending inwardly from the front member, a back member coupled to a back of the seating top and extending generally away from the seating top, and a back lip extending inwardly from the back member. The front lip and the back lip provide front and back pockets in the seat unit, the front and back pockets sized to receive a respective one of the mounting elements therein. Joining elements are disposed at opposing sides of the seat unit for cooperating with joining elements of an adjacent seat unit for coupling the seat unit to an adjacent seat unit. The seat unit is resilient such that seat unit flexes to move the front lip and the back lip away from each other for installation over the mounting elements and the seat unit returns to a less flexed state as the front and the back lip move toward each other when the mounting elements are received in their respective front and back pockets.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

A perspective view of bleacher seats 100 including a bench top 102 for the bench seats is shown in FIG. 1. The bench top 102 includes a plurality of seat units 104 that, with mounting elements (not shown) provide the bench top 102. For the purpose of the present example, each bench seat of the bleacher seats 100 includes 10 seat units 104 disposed thereon to provide the bench top 102. The seat units 104 are mounted to provide the bench top 102, utilizing the mounting elements.

Figure 2:
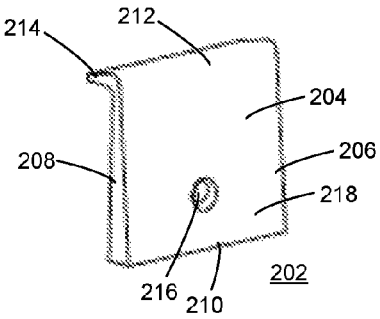
FIG. 2 is a perspective view of a mounting element of the bench top in accordance with an aspect of an embodiment of the present invention.
Figure 3:
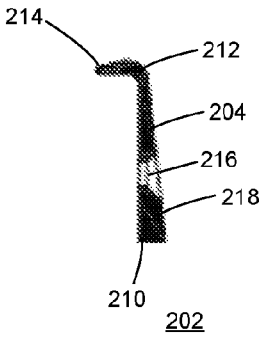
FIG. 3 is a sectional view of the mounting element of FIG. 2.

A mounting element 202 for mounting the seat units 104 in accordance with an embodiment is illustrated in FIG. 2 and FIG. 3. The mounting element 202 includes a main body 204 that has opposing side edges 206, 208, a bottom edge 210, and a top 212. In this example, a flange 214 extends from the top 212 of the main body 204. When the mounting element 202 is mounted on a bench seat member, which may be an existing wood seat, aluminum seat, or frame, such as tube members for a bench seat, the flange 214 abuts a top surface of the bench seat member and the main body abuts a front or a rear surface of the bench seat member. Because the flange 214 abuts the top of the bench seat member, the flange 214 facilitates positioning the mounting element 202 in a suitable vertical location on the bench seat member.

The terms top, bottom, vertical, and side are utilized herein to describe the mounting elements and the seat unit in reference to their orientations and position when installed on a bench and are not intended to be otherwise limiting.

The main body 204 of the mounting element 202 is generally wedge-shaped such that the thickness of the main body 204 is greater near the bottom edge 210 than near the top 212.

In the present example, a hole 216 extends through the main body 204 and the hole is sized and shaped to receive a screw therein for coupling the mounting element 202 to the bench seat member. In this example, the hole 216 is sized and shaped for receiving the head of the screw such that the head of the screw is countersunk in the main body 204 and is generally flush with or does not protrude from the outer surface 218 of the main body 204.

The mounting elements 202 are relatively small compared to the seat unit 104 and are sized and shaped to be received in a pocket in an underside of the seat 104 as referred to below. The mounting elements 104 may be any suitable material such as HDPE (high density polyethylene) or any other suitable plastic.

Figure 4:
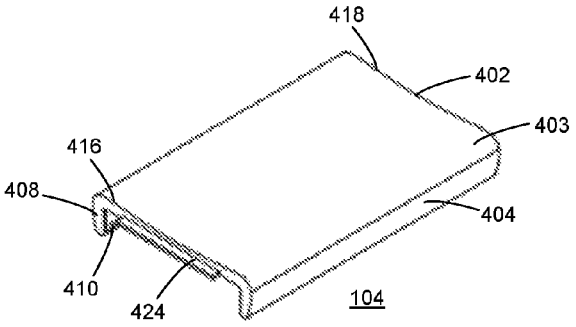
FIG. 4 is a top isometric view of a seat unit of a bench top in accordance with an aspect of an embodiment of the present invention.
Figure 5:
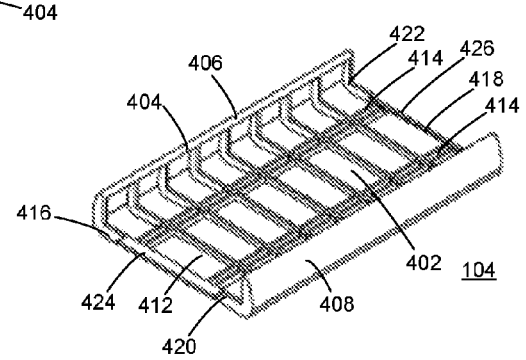
FIG. 5 is a bottom isometric view of the seat unit of FIG. 4.

Reference is now made to FIG. 4 and FIG. 5 to describe the seat unit 104. The seat unit 104 includes the seat top 402, which provides the seating surface 403 for sitting on. A front member 404 extends from the seat top 402, near a front thereof, and generally away from the seating surface 403. The front member 40 extends the length of the seat top 402. A front lip 406 extends substantially the full length of the front member 404 and extends inwardly from the front member 404.

A back member 408 extends from the seat top 402, near a back thereof, and generally away from the seating surface 403. The back member 40 extends the length of the seat top 402. A back lip 410 extends substantially the full length of the back member 408 and extends inwardly from the back member 408 such that the back lip 410 extends generally toward the front lip 406. Thus, the front lip 406 and back lip 410 extend generally toward each other.

A plurality of ribs extend from an underside 412 of the seat top 402, and from the front member 404 and the back member 408. In the present example, two pairs of ribs 414 extend from the underside of the seat top 402, along the length of the seat top 402, from a first side 416 of the seat unit 104 to a second side 418 of the seat unit 104, which is opposite the first side 416. The two pairs of ribs 414 are disposed on opposite sides of a center line along the length of the seat top 412 such that a first pair of the ribs 414 is disposed on one side of the center and a second pair of the ribs 414 is disposed on an opposite side of the center.

Cross-ribs extend generally perpendicular to the pairs of ribs 414 that extend along the length of the seat top 402. In the present example, the cross-ribs include two outer cross-ribs 420 that are located at the opposing first and second sides 416, 418 of the seat unit 104, and seven inner cross-ribs 422 that are located between the outer cross-ribs 420 and are generally equally spaced apart along the length of the seat top 402 and cross the pairs of ribs 414. Each of the cross-ribs, including the outer cross-ribs 420 and the inner cross-ribs 422 extend along the entire width of the seat top 402, inwardly along the back member 408 to the back lip 410, and inwardly along the front member 404 to the front lip 406.

The pairs of ribs 414, the outer cross-ribs 420, and the inner cross-ribs 422 provide support for rigidity and strength of the seat unit 104. The outer cross-ribs 420, and the inner cross-ribs 422 are sized to abut a bench seat member or members of the bleacher seats, that provide a supporting surface for the bench top 102 including each seat unit 104. The outer cross-ribs 420, and the inner cross-ribs 422 also, together with the front lip 406 and the back lip 410, provide pockets in the underside of the seat unit 104 in which the mounting elements 202 are received for mounting the seat unit 104 to the supporting surface of the bleacher seats 100. Thus, the cross-ribs are sufficiently spaced to receive a mounting element 202 between adjacent cross-ribs.

Joining elements are disposed at the opposing first and second sides 416, 418 of the seat unit 104. In this example, the joining elements include a tongue 424 extending outwardly from the outer cross-rib 420 on the first side 416 of the seat unit 104. The tongue 424 is generally centered on the outer cross-rib 420, and extends about two thirds of the width of the seat top 402. The joining elements also include a groove 426 in the outer cross-rib 420 on the second side 418 of the seat unit 104. The groove 426 is provided by a portion of the outer cross-rib 420 on the second side 418 of the seat unit 104 that does not extend as far from the underside of the seat top 402 and is sized to receive a corresponding tongue of an adjacent seat unit 104.

The seat unit 104, including the seat top 402, the front member 404, the front lip 406, the back member 408, and back lip 410, the ribs 414, 420, 422, and the tongue 424 are all comprised of molded plastic such as HDPE, which may, for example, be injection molded. Thus, the seat unit 104 is a unitary piece of molded plastic. Each seat unit is between about 17 inches (43 cm) and about 19 inches (48.3 cm) in length. For example, each seat tip 402 may be about 18 inches (45.7 cm) in length from the first side 416 to the second side 418 to provide about 18 inches (45.7 cm) of seating width, which is considered a single seat width. The seat unit 104 may be formed such that the seat top 402, the front member 404, and the back member 408 are shaped to provide a generally comfortable seat with rounded edges, by comparison to a wood plank or aluminum bench seat.

Figure 6:
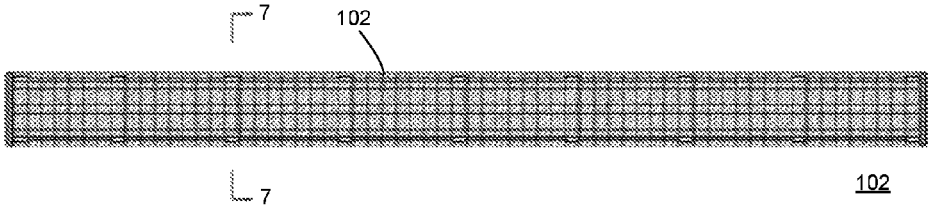
FIG. 6 is a top view of a bench seat of the bleacher seats, including the bench top of FIG. 4, in accordance with an aspect of the present invention.
Figure 7:
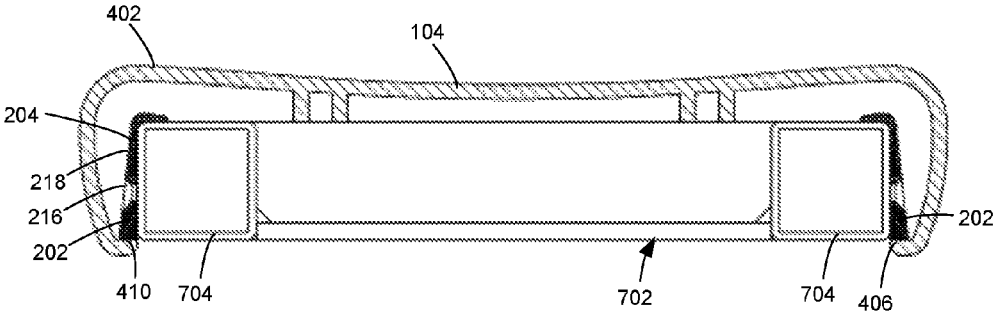
FIG. 7 is a sectional view of the bench top, through the line 7-7 of FIG. 4.

A top view of a bench top 102 installed on bleacher seats, including the seat units 104, is shown in FIG. 6. A sectional view of the bench top 102, through the line 7-7 of FIG. 6 is shown in FIG. 7. The sectional view of the bench top 102 is taken between the outer cross-rib 420 on the second side 418 of one of the seat units 104 and the next, or adjacent inner cross-rib 422. For the purpose of this example, the bench top 102 is installed on a bleacher seat frame 702 of, for example, galvanized steel. The frame 702 includes the bench seat members, which in this example are two spaced apart steel tubes 704 of generally square cross-section. The steel tubes 704 are coupled together by a base 706 extending between sidewalls of the steel tubes 704.

When installed in the bleacher seats, the mounting elements 202 are installed prior to the seat top 402. In this example, two mounting elements 202 are utilized for each seat unit 104, with one of the mounting elements 202 on one of the steel tubes 704 and one of the mounting elements 202 on the other of the steel tubes 704. The seat top 402 of each seat unit is about 18" (45.7 cm) and thus, the mounting elements 202 are installed at locations 18" apart along the outside of each of the two steel tubes 704. In the example of FIG. 6, eight seat units 104 together form the bench top 102. Thus, eight mounting elements 202 are disposed on one of the steel tubes 704 and eight mounting elements 202 are disposed on the other of the steel tubes 704. The mounting elements 202 are located in pairs at similar locations on each of the steel tubes 704.

Each of the mounting elements 202 is located on the respective steel tube 704 such that the flange 214 of the mounting element 202 abuts a top of the steel tube 704. The mounting element 202 is coupled to the steel tube 704 by drilling a hole in the steel tube 704 that aligns with the mounting hole 216 of the mounting element 202 when the mounting element 202 is located along the steel tube 704. The screw is countersunk in the hole 216 such that the screw is generally flush with the outer surface 218 of the main body 204 of the mounting element or such that the screw does not protrude from the outer surface 218.

After mounting the mounting elements 202 on the steel tubes 704, each seat unit 104 is pushed over the mounting elements 202 by pressing a first seat unit 104 over the steel tubes 704. As the seat unit 104 is pushed over the steel tubes 704, which include the mounting elements 202, the seat unit 104 flexes to move the front lip 406 and the back lip 410 away from each other. As described above, the mounting elements 202 are wedge-shaped and are thicker near the bottom than near the top of the main body 204 of the mounting elements 202. Thus, the flexing of the seat unit 104 is increased as the seat unit is moved down over the mounting elements 202. When the front lip 406 is moved past the mounting element 202 against which the front lip 406 slides during installation, and the back lip 410 is moved past the mounting element 202 against which the back lip 410 slides, the seat unit 104 returns to a less flexed state and the front lip 406 and the back lip 410 move back toward each other as the mounting elements 202 are received in respective pockets defined by the ribs and the front and back lips 406, 408. One of the mounting elements 202 is received in a front pocket, between the outer cross-rib 420 at the second side 418 of the seat unit 104 and the next adjacent inner cross-rib 422. Thus, the outer cross-rib 420 at the second side 418 of the seat unit 104, the front lip 406, and the next adjacent inner cross-rib 422 define the front pocket in which one of the mounting elements 202 is received. The front lip 406 abuts the bottom edge 210 of the mounting element 202 to inhibit the seat unit 104 from lifting off the bench seat member.

The other mounting element 202 is received in a back pocket, between the outer cross-rib 420 at the second side 418 of the seat unit 104 and the next adjacent inner cross-rib 422. Thus, the outer cross-rib 420 at the second side 418 of the seat unit 104, the back lip 410, and the next adjacent inner cross-rib 422 define the back pocket in which the other mounting element 202 is received. The back lip 408 abuts the bottom edge 210 of the mounting element 202 to inhibit the seat unit 104 from lifting off the bench seat member.

The second seat unit 104 is then installed by locating the tongue 424 on the first side 414 of the second seat unit, in the complementary groove 426 on the second side of the first seat unit 104 that is already installed. The second seat unit 104 is then pushed over the respective mounting elements 202 by pressing the second seat unit 104 over the steel tubes 704. As described above with reference to the first seat unit 104, the second seat unit 104 is pushed over the steel tubes 704, which include the mounting elements 202, the second seat unit 104 flexes to move the front lip 406 and the back lip 410 away from each other until the front lip 406 moves past the mounting element 202 against which the front lip 406 slides and the back lip 410 is moved past the mounting element 202 against which the back lip 410 slides. The second seat unit 104 returns to a less flexed state and the mounting elements 202 are received in respective front and back pockets defined by the ribs and the front and back lips 406, 408, as described above with reference to the first seat unit 104.

Each successive seat unit 104 is installed as described with the tongue 424 of each successive seat unit 104 received in the complementary groove 426 of the previous seat unit 104 such that the second side 418 of one seat unit 104 abuts a first side 416 of the next, adjacent seat unit 104. End caps of plastic may be installed at each end of the bench top 102 to finish the ends of the bench top 102.

For each seat unit 104, pockets in which the mounting elements 202 are received are located near the second side 418 of the seat unit 104. The front lip 406 and the back lip 410, facilitate retention of the first seat unit in coupling with the bench seat members, which in the above-described example are steel tubes 704. The tongue 424 of the second seat unit 104 is received in the groove 426 at the second side 418 of the first seat unit, which is retained in coupling with the steel tubes 704. Thus, the first seat unit 104 also facilitates retention of the second seat unit 104 in coupling with the steel tubes 704 because the tongue 424 of the second seat unit 104 is received in the groove 426 of the first seat unit 104, inhibiting lifting of the second seat unit 104 off of the steel tubes 704. Thus, retention of each successive seat unit 104 is facilitated by the use of the mounting elements 202 of each seat unit 104 and the receipt of the tongue 424 in the groove of the previous seat unit 104.

Figure 8:
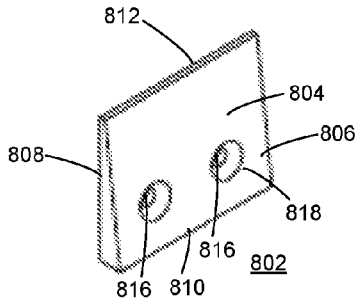
FIG. 8 is a perspective view of a mounting element of the bench top in accordance with another aspect of an embodiment of the present invention.
Figure 9:
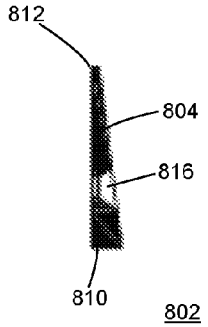
FIG. 9 is a sectional view of the mounting element of FIG. 8.

A mounting element according to an alternative embodiment is shown in FIG. 8 and FIG. 9. The mounting element 802 in the present embodiment includes a main body 804 that has opposing side edges 806, 808, a bottom edge 810, and a top edge 812. In this example, the mounting element does not include a flange. When the mounting element 202 is mounted on a bench seat member, which may be an existing wood seat, aluminum seat, or frame, such as tube members for a bench seat, the bottom edge 810 of the mounting element 202 is generally aligned with a bottom of the bench seat member.

The main body 804 of the mounting element 802 is generally wedge-shaped such that the thickness of the main body 804 is greater near the bottom edge 810 than near the top edge 812.

In the present example, two holes 816 extend through the main body 804 and the holes are sized and shaped to receive respective screws therein for coupling the mounting element 802 to the bench seat member. In this example, the holes 816 are sized and shaped for receiving the head of a screw such that the head of the screw is countersunk in the main body 804 and does not protrude from the outer surface 818 of the main body 804.

Figure 10:
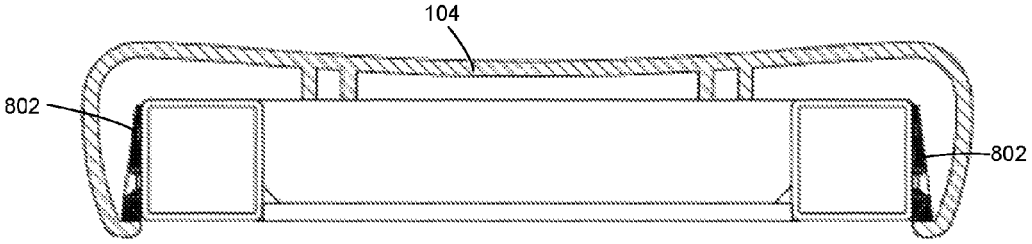
FIG. 10 is a sectional view of a bench top in accordance with another aspect of an embodiment.

A sectional view through the seat unit 104 and the mounting elements 802 for the seat unit 104 is shown in FIG. 10. The use and installation of the mounting elements 802 with the seat unit 104 is similar to that described above with respect to the mounting element shown in FIG. 2 and FIG. 3 and is therefore not further described herein. In the present case, however, each mounting element 802 is coupled to the bench seat by two screws rather than one screw.

Figure 11:
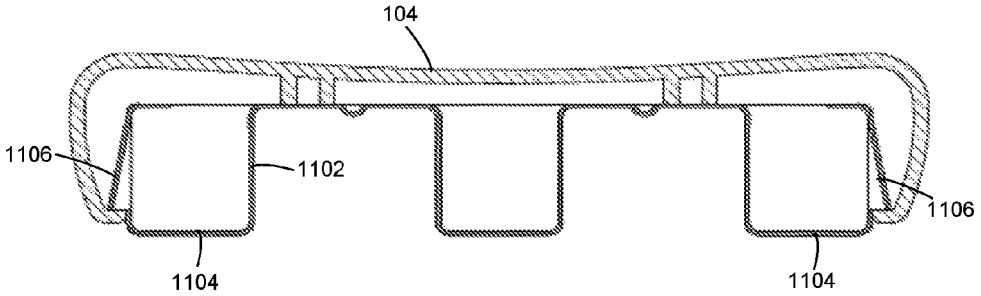
FIG. 11 is a sectional view of a bench top in accordance with yet another aspect of an embodiment.

A sectional view of a bench top in accordance with another aspect of an embodiment is shown in FIG. 11. In this example, the frame 1102 includes bench seat members that are formed of a single sheet of sheet metal formed to include longitudinally extending members 1104 of generally rectangular cross-section that provide strength and rigidity. In this example, the sheet metal includes mounting elements 1106 formed therein. Thus, no additional mounting elements are coupled to the frame 1102. The seat unit 104 is installed on the mounting elements 1106, which are part of the sheet metal frame 1102.

The installation of the seat unit 104 is similar to that described above and is therefore not further described herein. In the present case, however, no mounting elements are installed on the bench seat members because the frame 1102 already includes the mounting elements.

Figure 12:
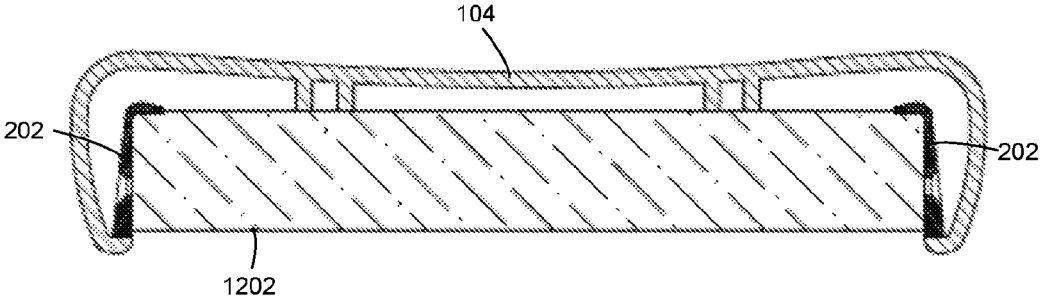
FIG. 12 is a sectional view of a bench top in accordance with yet another aspect of an embodiment.

A sectional view of a bench top in accordance with another aspect is shown in FIG. 12. In this example, the bench top, including the seat unit 104 and the mounting elements 202 as described hereinabove are installed on a pre-existing wood bench. Thus, rather than two steel tubes 704, the bench seat member is a single wood plank 1202. The mounting elements 202 are installed on opposing sides of the wood plank 1202. The installation of the seat unit 104 is similar to that described above and is therefore not further described herein.

Figure 13:
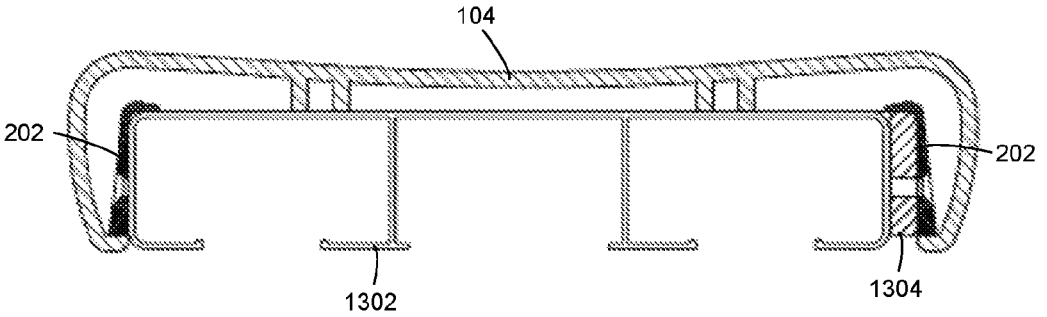
FIG. 13 is a sectional view of a bench top in accordance with still another aspect of an embodiment.

A sectional view of a bench top in accordance with still another aspect is shown in FIG. 13. In this example, the bench top, including the seat unit 104 and the mounting elements 202 as described hereinabove are installed on a pre-existing aluminum bench 1302. Thus, rather than two steel tubes 704, the bench seat member is a longitudinally extending aluminum bench. The mounting elements 202 are installed on one side of the aluminum bench 1302 by screwing the mounting elements 202 directly to the aluminum bench 1302. The aluminum bench, however, is not of sufficient width in this example, and thus, shims 1304 are is installed between the mounting elements on the other side of the aluminum bench 1302 and the mounting elements 202. The shims 1304 may be installed on the front side or the back side of the aluminum bench 1302 but all of the shims are installed on the same side of the aluminum bench 1302 for each of the seat units 104. The installation of the seat unit 104 is similar to that described above and is therefore not further described herein.

Advantageously, the bench top includes a plurality of seat units that are utilized together to create the seat surface. By using several seat units for a single bench, the seat units are less likely to warp or to bend during forming or as a result of exposure to elements by comparison to a single extruded bench or bench cover. Additionally, the seat units may be installed on new bench frames or on pre-existing benches. The screws that are utilized to couple the mounting elements to the bench seat members are not exposed when the seat unit 104 is installed. Thus, the screws are concealed, along with the mounting elements. In addition, each seat unit includes cooperating complementary joining elements to maintain the seat units on the bench seat members.

The scope of the claims should not be limited by the preferred embodiments set forth in the examples, but should be given the broadest interpretation consistent with the description as a whole.

What is claimed is:

1. A seat unit for a bench seat, the seat unit comprising:

a seating top;

a front member coupled the seating top and extending generally away from the seating top, and a front lip extending inwardly from the front member;

a back member coupled to a back of the seating top and extending generally away from the seating top, and a back lip extending inwardly from the back member;

mounting elements configured to be coupled to sides of the bench seat, each of the mounting elements including a main body having opposing sides edges, a bottom edge, and a top;

wherein the front lip and the back lip provide front and back pockets sized to receive a respective mounting element of the mounting elements therein; and joining elements at opposing sides of the seat unit for cooperating with joining elements of an adjacent seat unit for coupling the seat unit to an adjacent seat unit;

wherein the seat unit is resilient such that seat unit flexes for moving the front lip and the back lip away from each other for installation over the mounting elements when the mounting elements are coupled to the sides of the bench seat, and returning to a less flexed state as the front and the back lip move toward each other when the mounting elements are received in their respective front and back pockets.

2. The seat unit according to claim 1; comprising ribs extending inwardly, from the front member and from the back member, ones of the ribs, together with the front lip and the back lip providing the front and back pockets.

3. The seat unit according to claim 1, wherein the joining elements include a tongue projecting from a first one of the sides of the seat unit and a groove extending from a second one of the sides of the seat unit, opposite the first one of the sides of the seat unit, the tongue for insertion into a complementary groove of a first adjacent seat unit and the groove for receiving an complementary tongue of a second adjacent seat unit.

4. The seat unit according to claim 3, wherein the pockets in which the mounting elements are received are disposed near the second one of the sides of the seat unit that includes the groove for maintaining the seat unit in connection with the bench seat and inhibiting lifting of the adjacent seat unit when the tongue of the second adjacent seat unit is inserted into the groove of the seat unit.

5. The seat unit according to claim 1, wherein the main body of the mounting elements is generally wedge-shaped such that the main body is thicker near the bottom edge than near the top.

6. The seat unit according to claim 1, wherein the front lip abuts the bottom edge of a first one of the mounting elements and the back lip abuts the bottom edge of a second one of the mounting elements when the mounting elements are received in their respective front and back pockets.

7. The seat unit according to claim 6, wherein the first one of the mounting elements is received between one of the sides of the bench seat and one of the ribs and the second one of the mounting elements is received between the one of the sides of the bench seat and one of the ribs.

8. The seat unit according to claim 1, wherein the mounting elements include mounting holes in the main body for coupling the mounting elements to the sides of the bench seat and the seat unit covers and conceals couplings utilized with the mounting holes when the mounting elements are received in their respective front and back pockets.

9. The seat unit according to claim 1, wherein ones of the mounting elements include a flange at the top of the main body and extending therefrom for facilitating locating the mounting elements on the bench seat.

10. The seat unit according to claim 1, wherein at least one of the mounting elements is spaced from the bench seat by a shim coupled between the bench seat and the at least one of the mounting elements.

11. The seat unit according to claim 1, wherein the seat unit is a unitary piece of molded plastic.

12. A bench top for a bench seat, the bench top comprising:

mounting elements for coupling to sides of bench seat members, the mounting elements having a main body including opposing side edges, a bottom edge, and a top;

a plurality of seat units, each comprising:

a seating top;

a front member coupled the seating top and extending generally away from the seating top, and a front lip extending inwardly from the front member;

a back member coupled to a back of the seating top and extending generally away from the seating top, and a back lip extending inwardly from the back member;

the front lip and the back lip providing front and back pockets sized to receive respective mounting elements therein; and joining elements at opposing sides of the seat unit for coupling the adjacent ones of the plurality of seat units;

wherein the seat units are resilient such that the seat units flex to move the front lip and the back lip away from each other for installation over the mounting elements and the seat units return to a less flexed state as the front and the back lip move toward each other when the mounting elements are received in their respective front and back pockets; and wherein the seat units abut the adjacent ones of the plurality of seat units at sides thereof to provide the bench top.

13. The bench top according to claim 12, comprising ribs extending inwardly, from the front member and from the back member, ones of the ribs, together with the front lip and the back lip providing the front and back pockets.

14. The bench top according to claim 13, wherein the main body of the mounting elements are generally wedge-shaped such that the main body is thicker near the bottom edge than near the top.

15. The bench top according to claim 14, wherein the front lip abuts the bottom edge of a first one of the mounting elements and the back lip abuts the bottom edge of a second one of the mounting elements when the mounting elements are received in their respective front and back pockets.

16. The bench top according to claim 15, wherein the first one of the mounting elements is received between one of the sides and one of the ribs and the second one of the mounting elements is received between the one of the sides and one of the ribs.

17. The bench top according to claim 12, wherein the joining elements include a tongue projecting from a first one of the sides and a groove extending from a second one of the sides, opposite the first one of the sides, the tongue for insertion into a complementary groove of a first adjacent one of the seat units and the groove for receiving a complementary tongue of a second adjacent one of the seat units.

18. The bench top according to claim 17, wherein the pockets in which the mounting elements are received are disposed near the second one of the sides that includes the groove for maintaining one of the seat units in connection with the bench seat members and inhibiting lifting of a second adjacent seat unit of the seat units when the tongue of the second adjacent seat unit of the seat units is inserted into the groove of the one of the seat units.

19. The bench top according to claim 12, wherein the mounting elements include mounting holes in the main body for coupling the mounting elements to the sides of the bench seat members and the seat units cover and conceal couplings utilized with the mounting holes when the mounting elements are received in their respective front and back pockets.

20. The bench top according to claim 12, wherein ones of the mounting elements include a flange at the top of the main body and extending therefrom for facilitating locating the mounting elements on the bench seat members.

* * * * *